US008587394B1

(12) United States Patent
Song

(10) Patent No.: US 8,587,394 B1
(45) Date of Patent: Nov. 19, 2013

(54) REED SWITCH ASSEMBLY OF MAGNETIC LATCHING RELAY

(71) Applicant: Dongguan Sanyou Electrical Appliances Co., Ltd, Dongguan (CN)

(72) Inventor: Chao-Yang Song, Dongguan (CN)

(73) Assignee: Dongguan Sanyou Electrical Appliances Co., Ltd., Guangdong (CN)

( * ) Notice: Subject to any disclaimer, the term of this patent is extended or adjusted under 35 U.S.C. 154(b) by 0 days.

(21) Appl. No.: 13/739,355

(22) Filed: Jan. 11, 2013

(30) Foreign Application Priority Data

Oct. 27, 2012 (CN) ..... 2012 1 0416411

(51) Int. Cl.
*H01H 3/00* (2006.01)
*H01H 53/00* (2006.01)

(52) U.S. Cl.
USPC ..... 335/195; 335/16; 335/147

(58) Field of Classification Search
USPC ..... 335/16, 147, 151, 195
See application file for complete search history.

(56) References Cited

U.S. PATENT DOCUMENTS

| | | | | |
|---|---|---|---|---|
| 3,555,471 | A * | 1/1971 | Mitskevich et al. | 35/195 |
| 4,467,301 | A * | 8/1984 | Goodrich | 335/195 |
| 4,511,774 | A * | 4/1985 | Forsell | 218/30 |
| 5,898,148 | A * | 4/1999 | Zacharias et al. | 218/22 |
| 6,084,756 | A * | 7/2000 | Doring et al. | 361/45 |
| 6,373,014 | B1 * | 4/2002 | Mitsuhashi et al. | 218/22 |
| 8,373,523 | B2 * | 2/2013 | Valdemarsson | 335/16 |
| 2008/0012665 | A1 * | 1/2008 | DeBoer et al. | 335/16 |

* cited by examiner

*Primary Examiner* — Mohamad Musleh
(74) *Attorney, Agent, or Firm* — Ming Chow; Sinorica, LLC

(57) ABSTRACT

A reed switch assembly of a magnetic latching relay includes a movable reed, an immovable reed, a movable contact and an immovable contact. The movable contact and the immovable contact are disposed at respective ends of the movable reed and the immovable reed. The end with the movable contact of the movable reed is bent twice to form a reverse U-shaped end. The end with the immovable contact of the immovable reed is bent twice to form a U-shaped end. The reverse U-shaped end of the movable reed and the U-shaped end of the immovable reed are interlaced. The present invention further comprises a tension spring. One end of the tension spring is fixed to the reverse U-shaped end of the movable reed, and another end of the tension spring is mounted to a base of the magnetic latching relay.

2 Claims, 1 Drawing Sheet

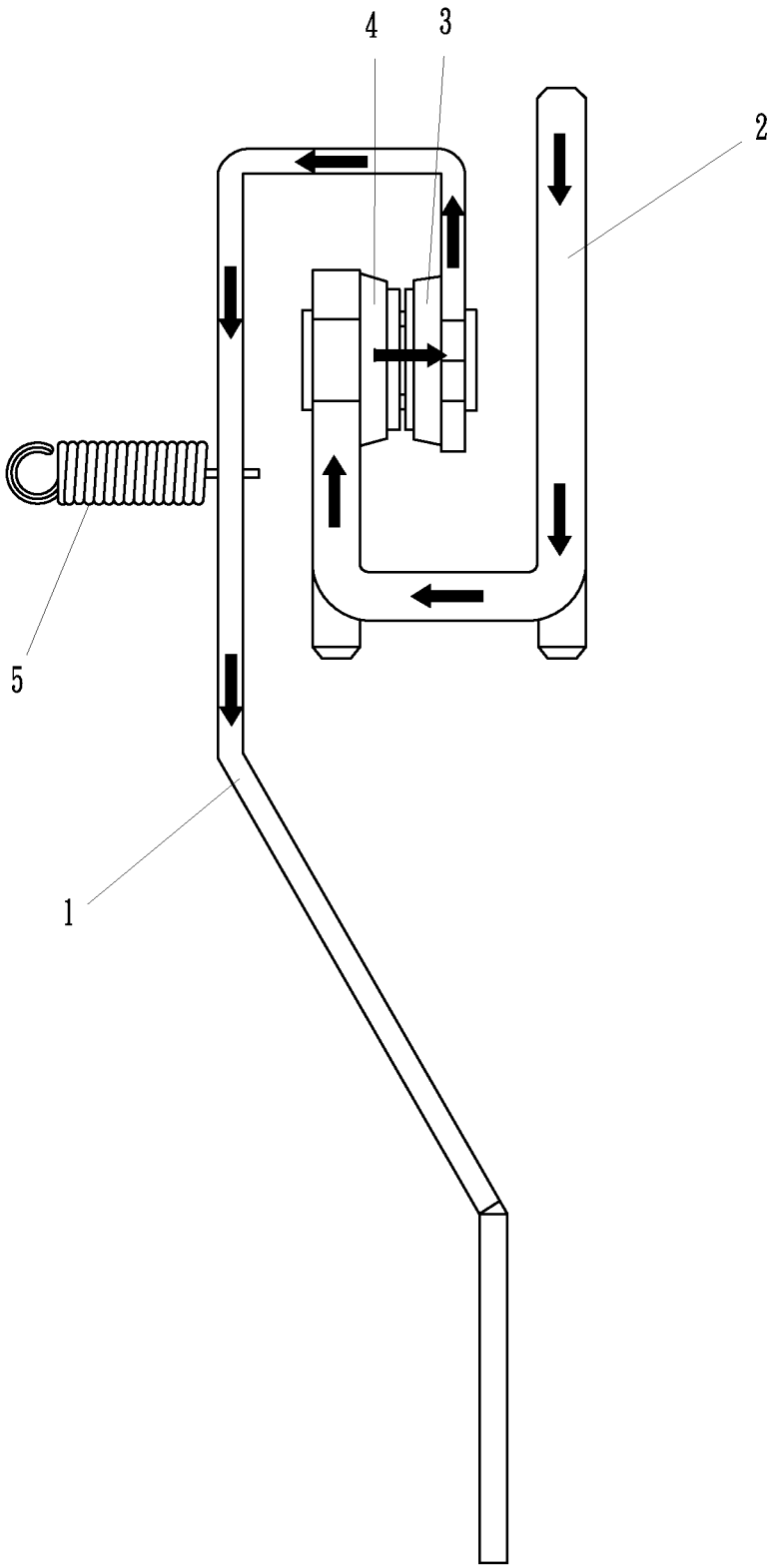
4
3
2
5
1

REED SWITCH ASSEMBLY OF MAGNETIC LATCHING RELAY

The current application claims a foreign priority to the patent application of China No. 201210416411.X filed on Oct. 27, 2012.

BACKGROUND OF THE INVENTION

1. Field of the Invention

The present invention relates to a reed switch assembly of a magnetic latching relay, and more particularly, to a reed switch assembly of a magnetic latching relay to resist high surge current.

2. Description of the Prior Art

A magnetic latching relay uses engagement and disengagement of the movable and immovable contacts of a reed switch assembly to achieve connection and disconnection of circuit. To disengage the movable contact is from the immovable contact will generate a repulsion force. The more the current is, the more the repulsion force will be. This will influence the contact of the movable and immovable contacts. In particular, the surge current will cause disengagement of the movable and immovable contacts so the magnetic latching relay is not stable.

Accordingly, the present invention intends to provide a reed switch assembly of a magnetic latching relay for improving the shortcomings mentioned above.

SUMMARY OF THE INVENTION

The primary object of the present invention is to provide a reed switch assembly of a magnetic latching relay to resist high surge current.

In order to achieve the aforesaid object, the reed switch assembly of a magnetic latching relay of the present invention comprises a movable reed, an immovable reed, a movable contact and an immovable contact. The movable contact and the immovable contact being disposed at respective ends of the movable reed and the immovable reed. The end with the movable contact of the movable reed is bent twice to form a reverse U-shaped end. The end with the immovable contact of the immovable reed is bent twice to form a U-shaped end. The reverse U-shaped end of the movable reed and the U-shaped end of the immovable reed are interlaced.

Preferably, the reverse U-shaped end of the movable reed and the U-shaped end of the immovable reed are bent twice at 90 degrees.

Preferably, the reed switch assembly of a magnetic latching relay further comprises a tension spring to increase the contact press of the movable and immovable contacts. One end of the tension spring is fixed to the reverse U-shaped end of the movable reed and another end of the tension spring is mounted to a base of the magnetic latching relay.

The work principle of the present invention is that when the movable and immovable contacts get contact with each other and the load current is conductive, the currents of the adjacent movable and the immovable reeds is flow in opposite directions. According to the Loren magnetic force principle that opposite currents generate a repulsion force, the portion having the movable contact of the movable reed will be influenced by the repulsive Loren magnetic force of the adjacent immovable reed and the portion having the immovable contact of the immovable reed will be influenced by the repulsive Loren magnetic force of the adjacent movable reed, so that the movable and immovable contacts are contact with each other firm. The more the current is, the more the Loren magnetic force will be. Thus, the movable and immovable contacts are contact with each other more firm.

The structure of the present invention is simple. By using the Loren magnetic force generated between anisotropic currents and the pull force of the tension spring relative to the movable reed for the movable contact to approach the immovable contact, the contact pressure of the movable and immovable contacts is increased to resist high surge current so as to enhance the reliability of the magnetic latching relay.

BRIEF DESCRIPTION OF THE DRAWINGS

FIG. 1 is a schematic view of the present invention.

DETAILED DESCRIPTION OF THE PREFERRED EMBODIMENTS

Embodiments of the present invention will now be described, by way of example only, with reference to the accompanying drawings.

As shown in FIG. 1, the reed switch assembly of a magnetic latching relay of the present invention comprises a movable reed 1, an immovable reed 2, a movable contact 3, an immovable contact 4 and a tension spring 5. The movable contact 3 and the immovable contact 4 are disposed at respective ends of the movable reed 1 and the immovable reed 2. The end with the movable contact 3 of the movable reed 1 is bent twice at 90 degrees to form a reverse U-shaped end. The end with the immovable contact 4 of the immovable reed 2 is bent twice at 90 degrees to form a U-shaped end. The reverse U-shaped end of the movable reed 1 and the U-shaped end of the immovable reed 2 are interlaced. One end of the tension spring 5 is fixed to the reverse U-shaped end of the movable reed 1, and another end of the tension spring 5 is mounted to a base of the magnetic latching relay.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A reed switch assembly of a magnetic latching relay, comprising a movable reed, an immovable reed, a movable contact and an immovable contact, the movable contact and the immovable contact being disposed at respective ends of the movable reed and the immovable reed, the end with the movable contact of the movable reed being bent twice to form a reverse U-shaped end, the end with the immovable contact of the immovable reed being bent twice to form a U-shaped end, the reverse U-shaped end of the movable reed and the U-shaped end of the immovable reed are bent twice at 90 degrees, the reverse U-shaped end of the movable reed and the U-shaped end of the immovable reed being interlaced, the currents of adjacent movable and immovable reeds flowing in opposite directions, a first repulsion generated between a bent part of the movable reed and its adjacent part on the immovable reed, and a second repulsion generated between a bent part of the immovable reed and its adjacent part on the movable reed.

2. The reed switch assembly of a magnetic latching relay as claimed in claim 1, further comprising a tension spring, one end of the tension spring being fixed to the reverse U-shaped end of the movable reed and another end of the tension spring being mounted to a base of the magnetic latching relay.

* * * * *